United States Patent [19]

Gushima et al.

[11] 3,947,753

[45] Mar. 30, 1976

[54] VOLTAGE REGULATOR INCLUDING AN LED TO PROVIDE A REFERENCE VOLTAGE

[75] Inventors: Hideki Gushima, Kodaira; Matsutoshi Ito, Narashino; Junichi Ishiwata, Yokohama, all of Japan

[73] Assignee: Canon Kabushiki Kaisha, Tokyo, Japan

[22] Filed: July 18, 1974

[21] Appl. No.: 489,844

Related U.S. Application Data

[63] Continuation of Ser. No. 356,205, May 1, 1973, abandoned.

[30] Foreign Application Priority Data

May 6, 1972 Japan ..... 47-48697

[52] U.S. Cl. ..... 323/21; 307/297; 307/318; 323/22 T; 323/22 Z; 340/252 R

[51] Int. Cl.[2] ..... G05F 1/56

[58] Field of Search ..... 323/21, 22 T, 22 Z; 307/311, 297, 296, 318; 333/17; 250/217 SS; 320/48; 340/252 R, 252 P, 249, 253 R

[56] References Cited

UNITED STATES PATENTS

| | | | |
|---|---|---|---|
| 2,974,270 | 3/1961 | Christiansen | 323/22 T |
| 2,984,779 | 5/1961 | Klees | 323/22 T |
| 3,201,606 | 8/1965 | Mamon | 323/22 Z |
| 3,359,483 | 12/1967 | Biard | 323/21 |
| 3,424,908 | 1/1969 | Sitter | 307/311 X |
| 3,466,572 | 9/1969 | Hanna et al. | 333/17 |
| 3,487,233 | 12/1969 | Reap | 323/22 Z |
| 3,534,354 | 10/1970 | Galginaitis | 320/48 |
| 3,693,027 | 9/1972 | Garaway | 323/21 X |
| 3,708,672 | 1/1973 | Marinkovic | 323/21 X |

OTHER PUBLICATIONS

*Electronic Design 4*, Feb. 15, 1975, p. 92.

Instruments and Control Systems, Dec. 1972, p. 48.

*Primary Examiner*—Gerald Goldberg
*Attorney, Agent, or Firm*—Fitzpatrick, Cella, Harper & Scinto

[57] ABSTRACT

A voltage regulator which includes an electrical circuit for maintaining a constant output, said electrical circuit including at least one light emitting diode connected to provide a reference voltage and to operate as a pilot lamp.

7 Claims, 2 Drawing Figures

VOLTAGE REGULATOR INCLUDING AN LED TO PROVIDE A REFERENCE VOLTAGE

This is a continuation of application Ser. No. 356,205, filed May 1, 1973, A CONSTANT VOLTAGE CIRCUIT, now abandoned.

BACKGROUND OF THE INVENTION

1. Field of the Invention

The present invention relates a constant voltage circuit with excellent volt-ampere and temperature characteristics for regulating especially a low load voltage.

2. Description of the Prior Art

The Zener diodes, which are designed to positively utilize their Zener effect and avalanche breakdown, have been widely employed as voltage reference or constant-voltage devices. A reverse bias current is nearly constant until the reverse bias voltage reaches a critical voltage at which the reverse current is abruptly and markedly increased. In the breakdown region the voltage across a Zener diode remains nearly constant independently of wide variation in current flowing therethrough. This phenomenon is used to regulate the load voltage against variation in load current and against variation in supply voltage. However, the breakdown voltage of a Zener diode is generally higher than 6 V even though it is lower than a constant voltage regulated by a constant-voltage discharge tube or the like. As a result the constant voltage circuit employing a Zener diode for regulating a load voltage lower than the breakdown voltage of the Zener diode is complex in construction, expensive to fabricate and unstable and inaccurate in operation because of the unsatisfactory volt-ampere and temperature characteristics of a Zener diode used.

In general the electronic devices including electronic computers, which become more and more complex both in construction and operation, demand constant voltage devices which are extremely reliable, stable, and accurate in operation. Especially the electronic circuits consisting of ICs and LSIs require constant voltage circuits with an extremely small voltage fluctuation.

SUMMARY OF THE INVENTION

One of the objects of the present invention is therefore to provide a constant voltage circuit employing an electroluminescent or light emitting diode which may overcome the above and other defects encountered in the prior art constant voltage devices and may satisfy the demands required for the recently developed electronic devices.

Another object of the present invention is to provide a constant voltage circuit which may regulate the load voltage with a higher degree of accuracy by utilizing the forward bias characteristics of a light emitting diode.

Another object of the present invention is to provide a constant voltage circuit in which light emitted by a light emitting diode is to indicate the operation of the constant voltage circuit.

The above and other objects, features and advantages of the present invention will become more apparent from the following description of one preferred embodiment thereof taken in conjunction with the accompanying drawing in which:

DESCRIPTION OF THE PREFERRED EMBODIMENTS

Figure 1:
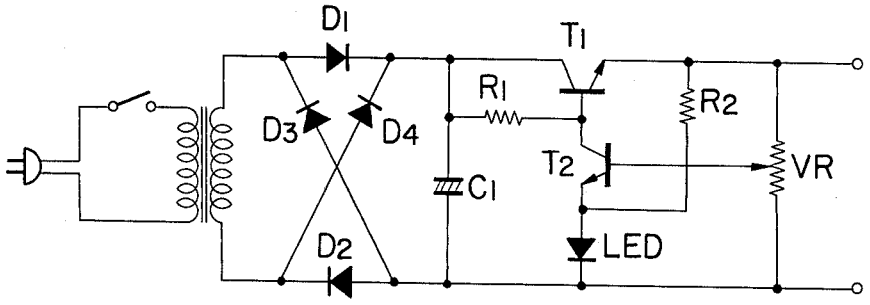
FIG. 1 is a circuit diagram of one embodiment of a constant voltage circuit in accordance with the present invention.

Referring to FIG. 1, four conventional diodes $D_1$–$D_4$ and a capacitor $C_1$ constitute a rectifier circuit, the output of which is applied to the collector of a transistor $T_1$ and to the base thereof through a resistor $R_1$. The base of the transistor $T_1$ is connected to the collector of a transistor $T_2$ whose emitter is connected to the anode of an electroluminescent or light emitting diode LED. The emitter of the transistor $T_1$ is also connected through a resistor $R_2$ to the anode of the light emitting diode LED. A variable resistor is inserted between the emitter of the transistor $T_1$ and the cathode of the light emitting diode LED, and an arm of the variable resistor VR is connected to the base of the transistor $T_2$ in order to control the feedback.

In the circuitry shown in FIG. 1, the light emitting diode is means for obtaining a reference voltage; the transistor $T_2$ is means for comparing the output voltage with a reference voltage, thereby detecting the error or difference; and the transistor $T_1$ is means for controlling the output voltage in response to the output of the detecting means, that is the transistor $T_2$.

The forward bias of the light emitting diode LED is derived as a constant output voltage, and whether the constant voltage circuit is supplying a predetermined constant voltage or not may be detected by the light emission by the diode LED. For example when the load current is varied and becomes lower than a predetermined level, the base potential of the transistor $T_2$ drops so that the collector current is reduced in proportion. As a result the base current of the transistor $T_1$ is increased to supplement the decrease in current flowing through the resistor $R_2$ and the variable resistor VR so that a constant output voltage may be always supplied. When the load current is increased, the base potential of the transistor $T_2$ is increased so that the collector current is increased. As a result the base current of the transistor $T_1$ is reduced so that the emitter current is reduced. The decreased emitter current cancels the increase in current flowing through the resistor $R_2$ and the variable resistor VR so that the output voltage may be always maintained at a constant level. In like manner the output voltage may be maintained constant even when the input or supply voltage is varied.

In order that the output voltage may be always maintained constant, the feedback must be positive and stable. The voltage across a diode must be always smaller than the voltage difference between the output voltage and the voltage between the emitter and base of the transistor $T_2$. A Zener diode cannot satisfy the above condition because its breakdown voltage is large. However according to the present invention a light emitting diode is used so that the above condition may be satisfied and the required constant voltage characteristics may be obtained.

Figure 2:
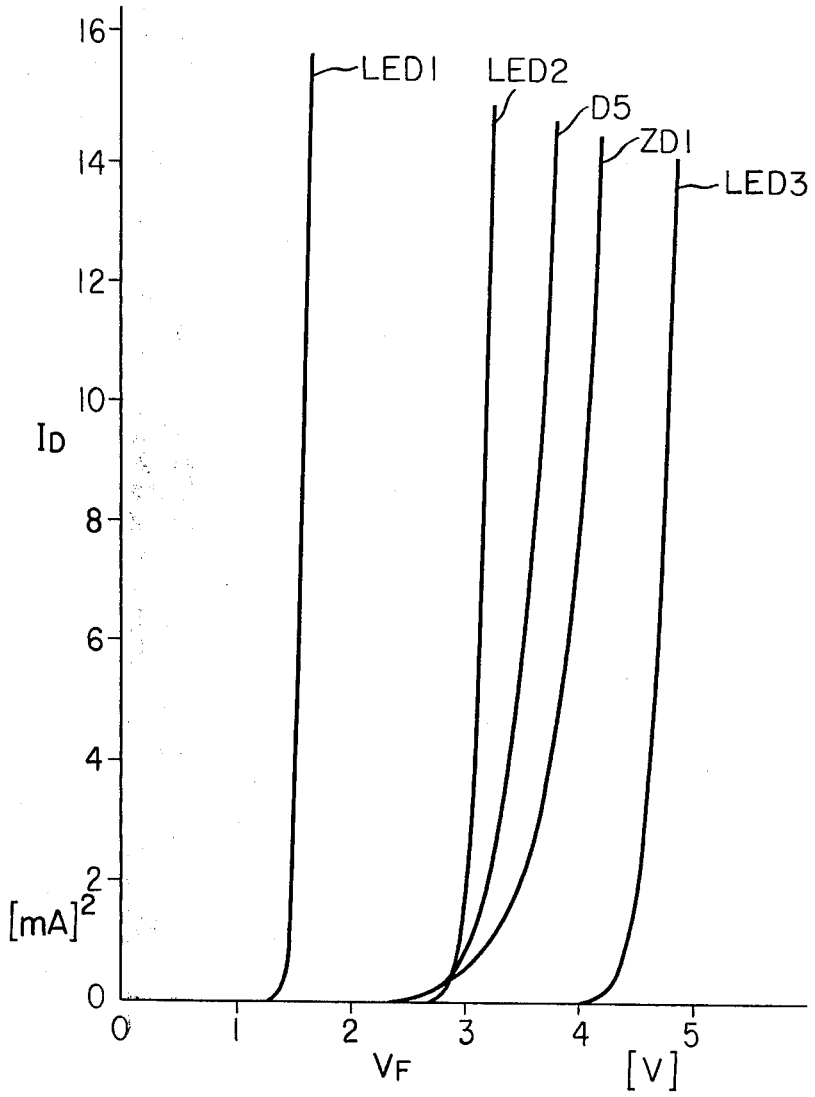
FIG. 2 is a graph illustrating the forward bias characteristics of a light emitting diode or diodes used in the present invention and of ordinary diodes and the reverse bias characteristics of a Zener diode.

Referring to FIG. 2, the forward bias characteristic curves LED1, LED2 and LED3 are for one light emitting diode, two diodes connected in series and three diodes connected also in series, respectively. The characteristic curve ZD1 represents the reverse bias characteristic of one Zener diode, whereas the characteristic curve D5 is for five diodes connected in series. The curves D5 and ZD1 have a dull knee or exhibit the poor rising characteristic. The steady voltage is gradually increased so that the accurate control of a constant voltage cannot be expected. On the other hand the curves LED1–LED3 have a sharp knee and exhibit the nearly idealistic characteristics. Especially a single light emitting diode exhibits the idealistic characteristics for regulating a low constant voltage.

It is to be understood that the present invention is not limited to the preferred embodiment described in detail hereinbefore and that various modifications can be effected without departing the true spirit of the present invention. Furthermore the temperature characteristic of a light emitting diode when forward biased will not affect the accurate function, and since a light emitting diode emits light when forward biased the operator may easily detect the operation of the constant voltage circuit when an on-off switch is thrown. In other words, the light emitting diode used in the constant voltage circuit in accordance with the present invention also functions as an indicating lamp which indicates that the power is on.

We claim:

1. A voltage regulator comprising means for maintaining an output voltage constant against voltage variations, wherein said maintaining means comprises at least one light emitting diode for providing a reference voltage, said light emitting diode having constant voltage characteristics in the forward direction thereof.

2. A voltage regulator as defined in claim 1, wherein said light emitting diode is forward biased.

3. A voltage regulator as defined in claim 1, wherein said light emitting diode establishes the reference voltage and in addition serves to indicate the operation of the voltage regulator.

4. A voltage regulator comprising:

means for supplying a power source voltage;

a light emitting diode for establishing a reference voltage; said light emitting diode having constant voltage characteristics in the forward direction thereof;

means connected to said light emitting diode for comparing a load voltage with the reference voltage from said light emitting diode and for detecting the difference therebetween; and means connected to said voltage supplying means and said detecting means for controlling the load voltage in response to an output of said detecting means to compensate for variations of the load voltage and the power source voltage.

5. A voltage regulator as defined in claim 4, wherein said light emitting diode is forward biased.

6. A voltage regulator as defined in claim 4, wherein said light emitting diode established the reference voltage and in addition serves to indicate the operation of the voltage regulator.

7. A voltage regulator comprising:

a rectifier circuit having first and second terminals for converting AC into DC;

first and second output terminals adapted to connect a load;

a light emitting diode for establishing a reference voltage; said light emitting diode having constant voltage characteristics in the forward direction thereof;

a first transistor for controlling an output voltage of the voltage regulator, the collector-emitter circuit of said first transistor being connected between said first terminal and said first output terminal;

a second transistor for detecting the difference between the output voltage and the reference voltage, the collector-emitter circuit of said second transistor being connected between the base of said first transistor and the anode of said light emitting diode, and the base of said second transistor being connected to the center tap of said potentiometer;

a first resistor for establishing a biasing voltage for said first and second transistors, said first resistor being connected between the collector and base of said first transistor;

a second resistor for connecting said light emitting diode and said first output terminal; and a potentiometer connected between said first output terminal and said second output terminal for dividing the output voltage, said potentiometer being connected in parallel with a path including said second resistor and said light emitting diode.

* * * * *